US009393830B1

(12) United States Patent
Logan

(10) Patent No.: US 9,393,830 B1
(45) Date of Patent: Jul. 19, 2016

(54) ARTISIT'S PAINT TUBE CARRYING UNIT

(71) Applicant: Diane B. Logan, Naples, FL (US)

(72) Inventor: Diane B. Logan, Naples, FL (US)

( * ) Notice: Subject to any disclaimer, the term of this patent is extended or adjusted under 35 U.S.C. 154(b) by 0 days.

(21) Appl. No.: 14/545,822

(22) Filed: Jun. 24, 2015

(51) Int. Cl.
*B44D 3/02* (2006.01)
*B44D 3/04* (2006.01)
*B65D 25/10* (2006.01)

(52) U.S. Cl.
CPC ..... *B44D 3/04* (2013.01); *B65D 25/108* (2013.01)

(58) Field of Classification Search
USPC ..... 206/1.7, 1.8, 1.9, 81, 277, 745, 751, 206/758, 759
See application file for complete search history.

(56) References Cited

U.S. PATENT DOCUMENTS

| | | | | | |
|---|---|---|---|---|---|
| 2,867,928 | A * | 1/1959 | Angell | B44D 3/04 | 206/1.8 |
| 3,273,700 | A * | 9/1966 | Moreau et al. | B44D 3/04 | 206/1.7 |
| 3,446,337 | A * | 5/1969 | Blackmon | B44D 3/04 | 206/1.7 |
| 3,650,380 | A * | 3/1972 | Hutchison | B44D 3/02 | 206/1.8 |
| 3,954,314 | A * | 5/1976 | Crawford | A47B 97/04 | 206/1.8 |
| 5,257,721 | A * | 11/1993 | Smith | B44D 3/04 | 206/1.7 |
| 2008/0156667 | A1* | 7/2008 | Huggins | B44D 3/04 | 206/1.8 |

* cited by examiner

*Primary Examiner* — Jacob K Ackun

(57) ABSTRACT

An artist's paint tube storage and transport carrying case having multiple rows of tube supporting structures wherein the tube necks are gripped and held in a desired position by resilient gripping fingers which are slidably mounted on lateral beam structures whereby the gripping fingers can be laterally adjustably positioned along the beam structures for accommodating tubes of various dimensions.

10 Claims, 5 Drawing Sheets

ARTISIT'S PAINT TUBE CARRYING UNIT

FIELD

This invention pertains to a paint tube storage and transport containment structure or unit in which artists can quickly and easily store or and use a multitude of paint tubes in a manner where the tubes are substantially isolated from each other, wherein the identification legend and the like on the tubes are clearly visible, wherein a simple manipulation of the tube support means provides immediate access to the tubes for use or for replacement to storage, wherein the tube holding structure is adjustable for allowing storage of tubes of varying dimensions and shapes, and wherein the tubes are properly restricted in movement within the box regardless of the posture of the unit, i.e., standing on its side, end, top or bottom.

PRIOR ART

Heretofore artists paint containers or boxes have been constructed whereby the tubes are either non-isolated, i.e., layed down and contacting each other side by side or on top of each other which allows the tubes to transfer paint drippings, paint smudges or the like from one tube to the other and create a messy situation wherein the artist's clothing or her person can be smeared with paint, or wherein the tube support means is not adjustable for accommodating a variety of tube dimensions, or the like which results in the artist having, e.g., to put larger tubes in another container.

SUMMARY OF THE INVENTION

The present invention provides within a carrying box structure a number of paint tube support structures which have a multiplicity of individual tube gripping elements which are slidably mounted on the supports for being position adjustable along the supports for accommodating and holding in a substantially isolated manner multiple paint tubes of varying body sizes and shapes, and wherein the supports are pivotal between substantially horizontal and substantially vertical postures within the unit for compact storage and for easy access to the tubes for use.

BRIEF DESCRIPTION OF THE DRAWINGS

The present invention will be further understood from the drawings herein and the description thereof wherein the figures are not necessarily drawn to scale or in consistent proportions but are intended to depict the principles of the present invention, wherein all geometric terms such as "plane", "horizontal", "vertical", "upright", etc. are in reference to the earths surface and wherein.

DETAILED DESCRIPTION

Figure 1:
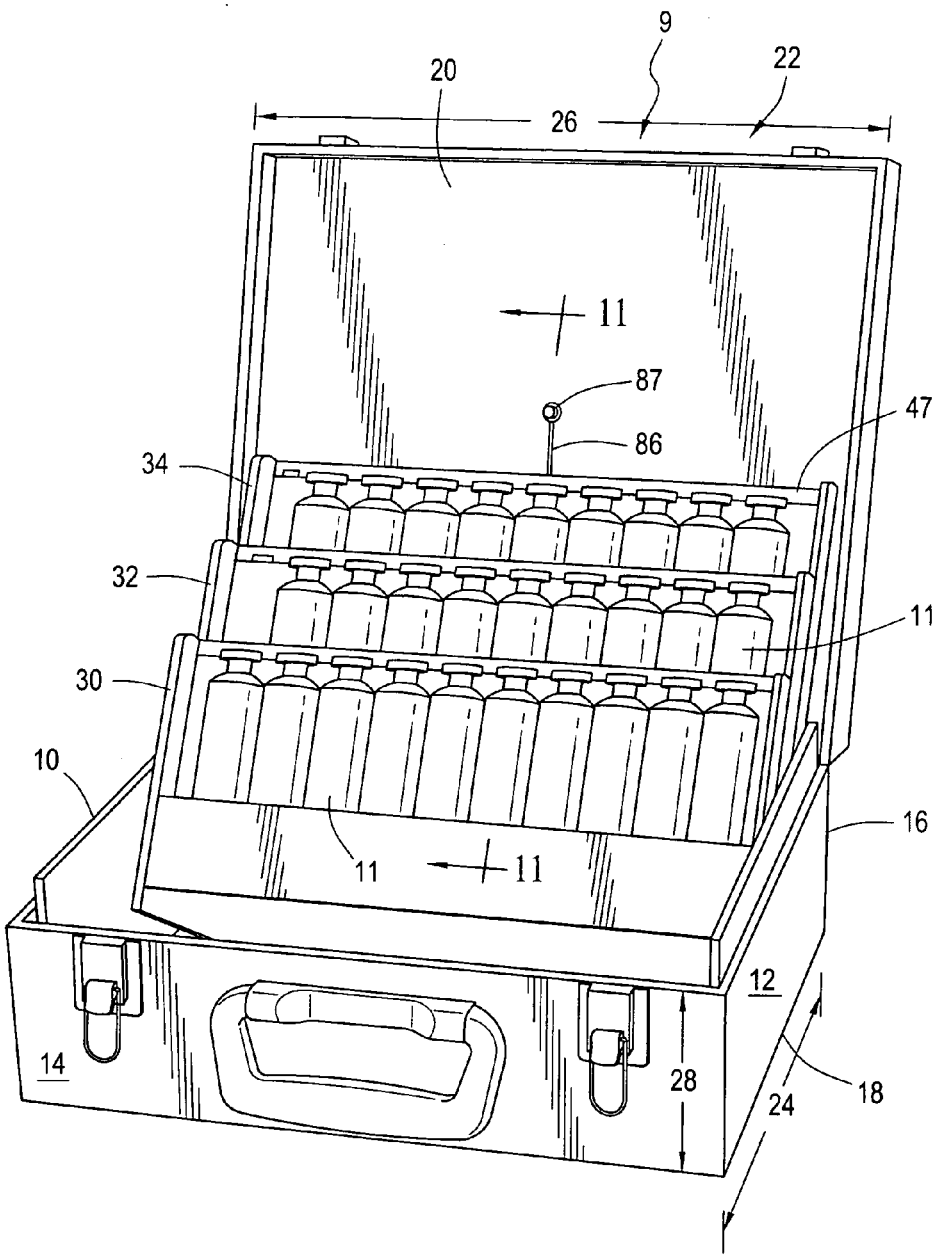
FIG. 1 is a perspective view of an embodiment of the present tube carrying unit.
Figure 2:
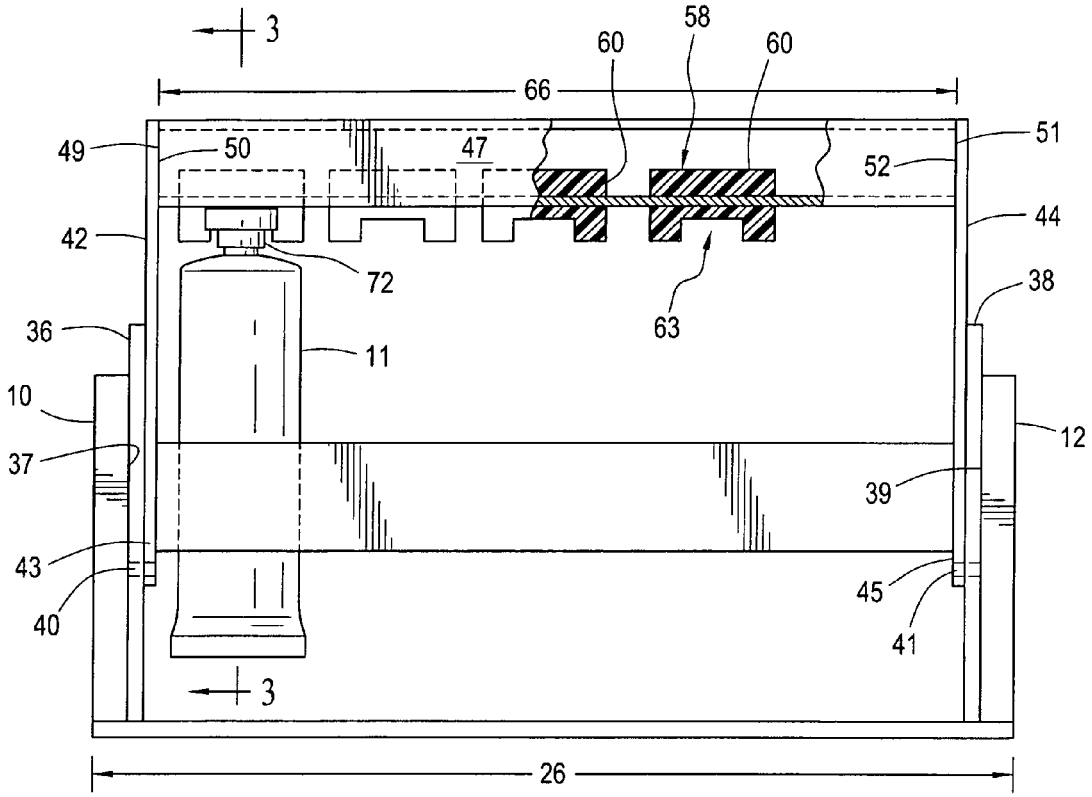
FIG. 2 is a front view of a paint tube support with portions in cross-section and showing a paint tube in upright use position.
Figure 3:
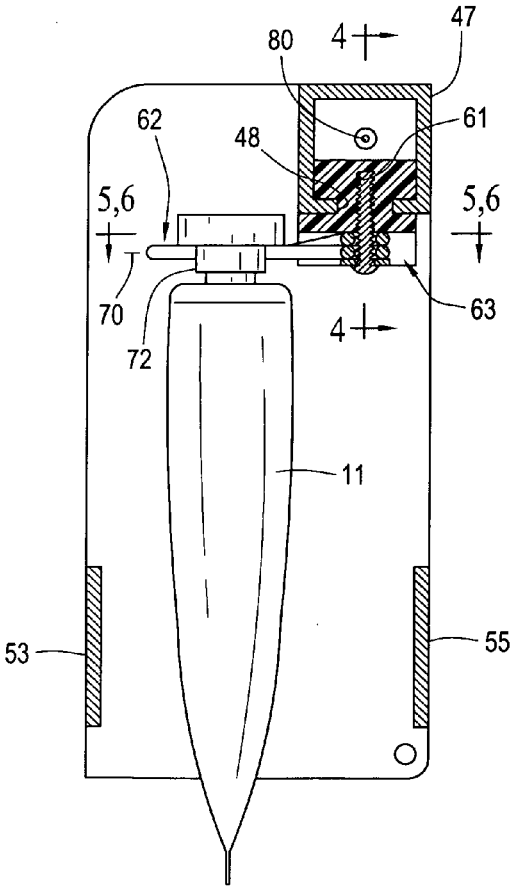
FIG. 3 is a cross-sectional view taken along line 3-3 in FIG. 2 showing a screw mounting for the torsion spring type finger gripper of FIG. 5 and with a paint tube being gripped and supported thereby but not in cross-section.

Referring to the drawings and with reference to the claims herein the present invention comprises an artist paint tube 11 storage and transport unit 9 having an outer containment means comprising a pair of opposing side walls 10, 12, opposing front 14 and rear end walls 16, a bottom wall 18 and a top cover wall 20 hinged at 21 to wall 16. These walls are arranged to form a substantially rectangular outer box 22 having a longitudinal dimension 24, a lateral dimension 26 and a vertical dimension 28. This unit further comprises any desired number of paint tube support structures 30, 32, 34 each having a functional plane 31, 33, 35 respectively, and each extending laterally between the side walls 10, 12. Each structure comprises a pair of opposing base sides 36, 38 each of which lie adjacent to an inner surface 37, 39 respectively of side walls 10, 12. Each support structure further comprising pivot arms 42, 44 having lower ends 43, 45, respectively pivotally mounted on base sides 36, 38. A guide beam 47 having a guide slot 48 in its bottom extends between and is affixed at its ends 49, 51 to upper end portions 50, 52 respectively of pivot arms 42, 44. The pivot points of the pivot arms on the support structures are on separate lateral axes 54, 56, 57 and are spaced longitudinally from each other and are spaced vertically from each other, whereby each support structure can be pivoted to place its functional plane 31, 33, or 35 in either a substantially horizontal orientation or a substantially vertical orientation within box 22. Laterally extending side panels 53, 55 provide accurate containment of the tubes when the support structures are pivoted away from their upright postures.

Each beam is provided with multiple paint tube grippers 58, each gripper having a body section 60, a mounting cavity 63 and a tube gripping section 62 affixed thereto. Each body section has a lateral dimension 64 and is mounted on a beam and slidable therealong laterally of the box. It is particularly noted that the combined lateral dimensions of all of the body sections on a single beam is substantially less than the lateral length 66 of the beam whereby the grippers 58 can be slid along the beam and whereby paint tubes of various sizes can be accommodated in close side-by-side but not necessarily contiguous arrangement on the beam. The gripping section 62 comprises laterally spaced resilient fingers 68 and their mounting means 69 lying in a gripping plane 70 and between which fingers the neck 72 of a paint tube can be pushed to forcefully and resiliently spread said fingers to frictionally hold the tubes in an upright posture on the support structure when in use.

Figure 4:
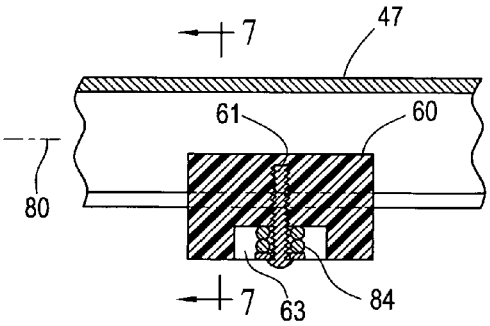
FIG. 4 is a cross-sectional view taken along line 4-4 in FIG. 3 and showing a mounting of the coil of a torsion spring on a gripper body.
Figure 5:
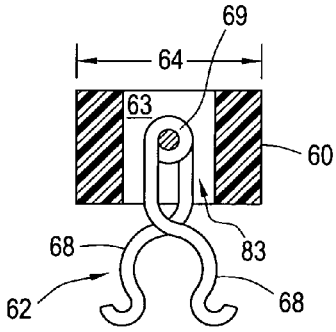
FIG. 5 is a cross-sectional view taken along line 5-5 in FIG. 3 and showing a preferred torsion spring embodiment of the gripper fingers.
Figure 6:
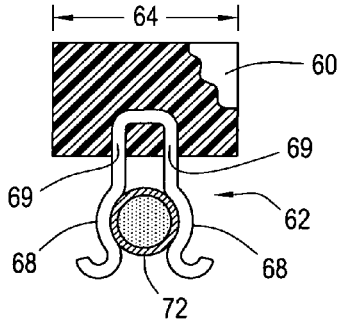
FIG. 6 is a cross-sectional view taken along line 6-6 in FIG. 3 and showing a variation of the gripper fingers being affixed to the plastic gripper slide body by being imbedded therein during casting or molding of the plastic body.
Figure 8:
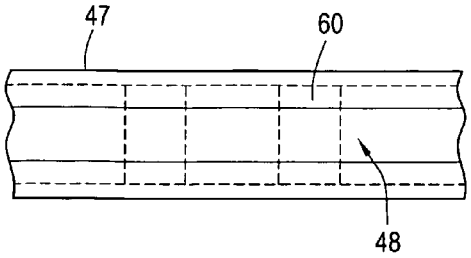
FIG. 8 is a bottom view of the guide beam depicting the guide slot and with the gripper body shown in dotted line.
Figure 7:
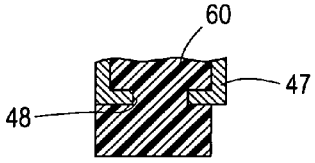
FIG. 7 is an enlarged for clarity cross-sectional view of the beam taken along line 7-7 in FIG. 4 and showing more clearly the guide grooves in the gripper body and the guide slot in the bottom web of the beam.
Figure 9:
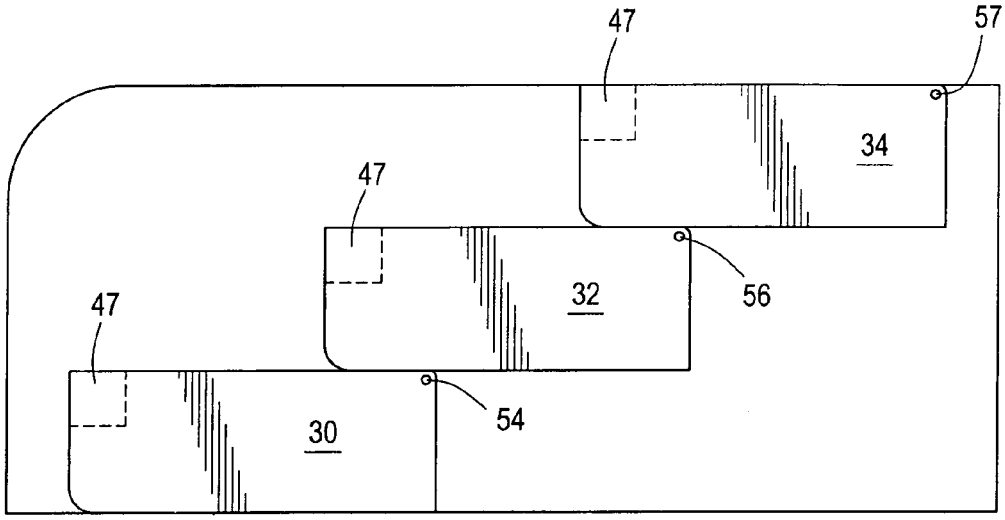
FIGS. 9 and 10 are end views of an array of support structures showing their horizontal stored position and a substantially upright functional positions.
Figure 10:
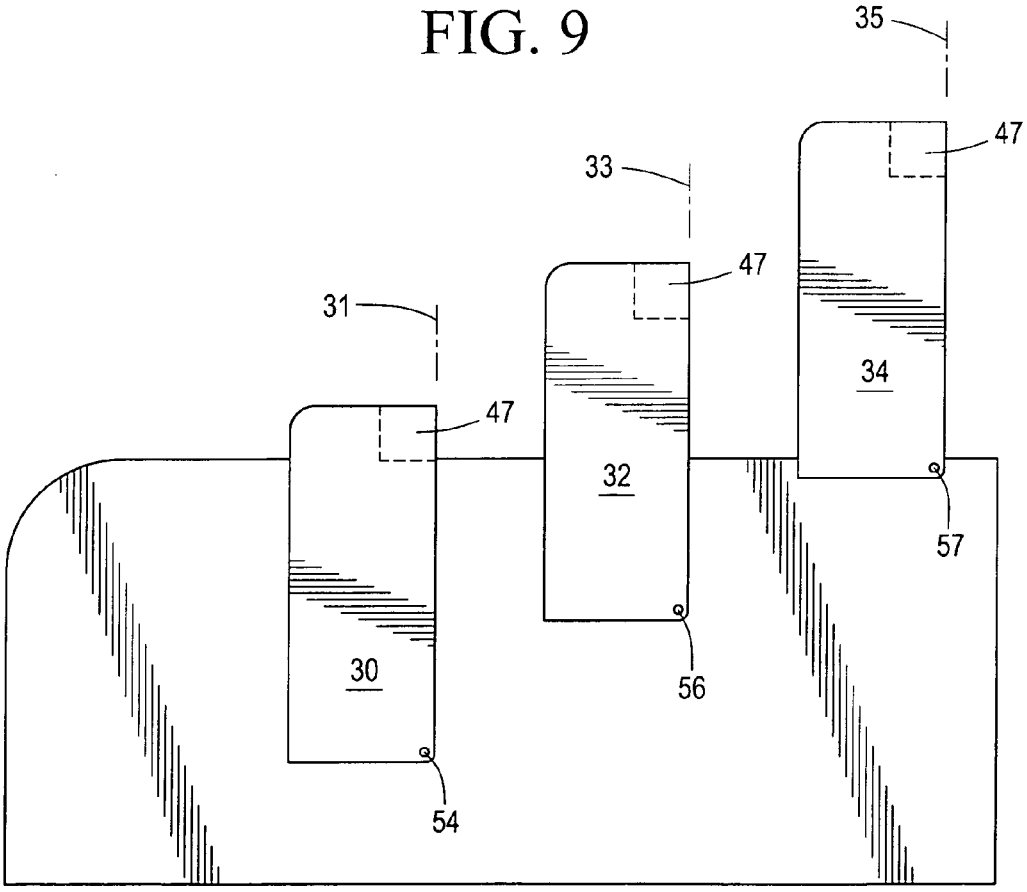

It is preferred that the fingers are comprised of spring steel wire. Also, it is preferred that each pivot axis of said pivot arms is spaced from and parallel to a longitudinal axis 80 of the beam, wherein the pivot axis of the arms and said longitudinal axis lie in said functional planes which intersects the gripping plane at a substantially right angle. Further, the fingers preferably as shown in FIGS. 4 and 5 comprise the free end portions 68 of a torsion spring 83, wherein a coil portion 84 of the spring is mounted on the body section 60 by screw 61.

Figure 11:
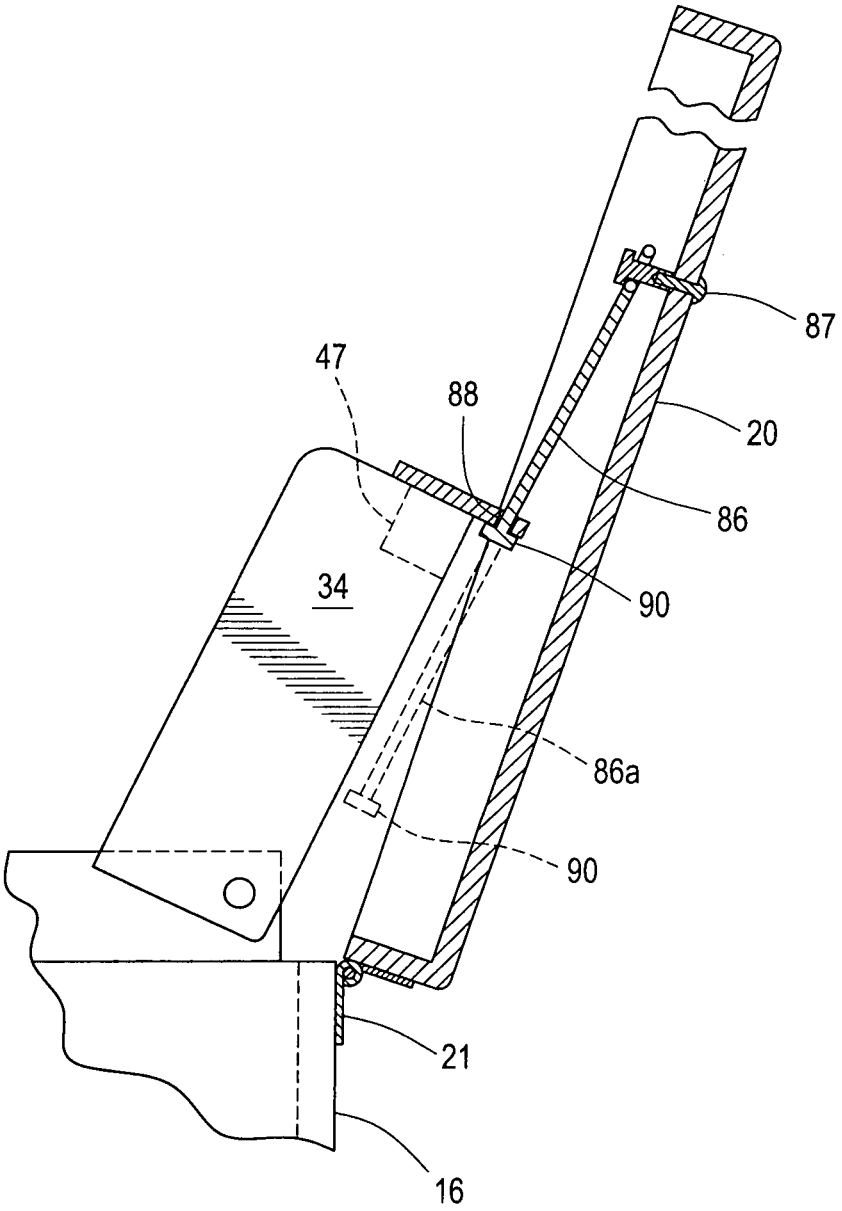
FIG. 11 is a partially sectioned side view of the present unit taken along line 11-11 in FIG. 1 and showing details of a preferred support stop (positioning) structure.

Referring to FIG. 11, a preferred stop structure comprises a shaft 86 affixed at one of its ends to the inside of the hinged cover 20 by, e.g., rivet 87 of the box, wherein an aperture 88 is provided in a portion of the beam structure of the rearward most support 34, wherein the shaft is slidably mounted through aperture 88, and wherein a stop shoulder 90 is provided on the other end of the shaft for stopping the opening of the cover at a desired posture generally upright. As the cover 20 is being pivoted to its closed position on the box, shaft 86 slides through aperture 88 as shown by dotted line 86A which allows cover 20 to completely close.

The invention has been described in detail with particular reference to preferred embodiments thereof, but it will be understood that variations and modifications will be effected within the spirit and scope of the invention.

I claim:

1. An artist paint tube carrying unit comprising an outer box, a number of paint tube supports contained within said box, a plurality of individual tube gripping elements slidably mounted on each said support for being position adjustable along said supports for accommodating and holding in a substantially close but substantially isolated manner multiple paint tubes of various tube sizes and shapes, and wherein said supports are pivotally mounted on side portions of said box for pivoting between substantially horizontal and substantially vertical postures within said box for compact storage therein and for easy access to the tubes for use respectively.

2. The unit of claim 1 wherein said gripping elements comprise laterally spaced resilient fingers and their mounting means, said fingers lying in a gripping plane and between which fingers the neck of a paint tube can be pushed to forcefully and resiliently spread said fingers to frictionally hold said tubes in an upright posture on said support structure when in use.

3. The unit of claim 2 wherein said mounting means of said gripping elements are slidably mounted on a beam structure which is affixed to and between upper end portions of a pair of laterally spaced support arms, wherein lower portions of said arms are pivotally mounted on side portions of said box.

4. The unit of claim 3 wherein said fingers are comprised of spring steel wire.

5. The unit of claim 3 wherein a pivot axis of said pivot arms is spaced from and parallel to a longitudinal axis of said beam structure, and wherein said pivot axis and said longitudinal axis lie in a plane which intersects said gripping plane at a substantially right angle.

6. The unit of claim 2 wherein said fingers comprise the free end portions of a torsion spring, wherein a coil portion of said spring is mounted on said mounting means.

7. The unit of claim 3 wherein said beam structure comprises metal tubing a wall of which is slotted longitudinally, and wherein said mounting means is grooved to slidably receive edge portions of the beam structure slot.

8. The unit of claim 7 wherein cooperating elements of a stop structure are provided on said box and on a rearward most support for positioning said support in a generally upright posture.

9. The unit of claim 8 wherein said stop structure comprises a shaft affixed at one of its ends to the inside of a lunged cover of said box, wherein an aperture is provided in a portion of the beam structure of said rearward most support, wherein said shaft is slidably mounted through said aperture, and wherein a stop shoulder is provided on the other end of said shaft for stopping the opening of said cover at a desired posture.

10. An artist paint tube storage and transport unit having an outer containment means comprising a pair of opposing side walls, opposing front and rear end walls, a bottom wall and a top cover wall, said walls being arranged to form a substantially rectangular outer box having a longitudinal dimension, a lateral dimension and a vertical dimension, said unit further comprising a series of paint tube support structures such as each having a functional plane respectively, each said support structures extending laterally between said side walls and comprising a pair of opposing base sides each lying adjacent to an inner surface respectively of said side walls each said support structure further comprising pivot arms having lower ends respectively pivotally mounted on said base sides, a guide beam extending between and affixed at its ends to upper end portions respectively of said pivot arms each pivot point of said pivot arms on said series of support structures being on separate lateral axes and are spaced longitudinally from each other, and spaced vertically from each other, whereby each support structure can be pivoted to place its functional plane in either a substantially horizontal orientation or a substantially vertical orientation within said box, wherein each said support is provided with multiple paint tube grippers, each gripper comprising a body section and a tube gripping section affixed thereto, each said body section having a lateral dimension and being mounted on said beam and slidable therealong laterally of said box, wherein the combined lateral dimension of all said body sections on a single beam is substantially less than the lateral length of the beam whereby the grippers can be slid along said beam whereby paint tubes of various sizes can be accommodated in close side-by-side arrangement on said beam.

* * * * *